US007832186B2

(12) United States Patent
Moncrief et al.

(10) Patent No.: US 7,832,186 B2
(45) Date of Patent: Nov. 16, 2010

(54) PACKAGING METHOD FOR STACKED ARTICLES

(75) Inventors: Frank N. Moncrief, Acworth, GA (US); David S. Clark, Dallas, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/618,075

(22) Filed: Nov. 13, 2009

(65) Prior Publication Data

US 2010/0058718 A1 Mar. 11, 2010

Related U.S. Application Data

(62) Division of application No. 11/773,031, filed on Jul. 3, 2007, now Pat. No. 7,637,083, which is a division of application No. 11/178,962, filed on Jul. 11, 2005, now Pat. No. 7,240,467.

(51) Int. Cl.
*B65B 35/50* (2006.01)

(52) U.S. Cl. ..... 53/447; 53/531; 53/540; 53/244

(58) Field of Classification Search ..... 53/447, 53/475, 153, 531, 540, 244, 282, 247, 251
See application file for complete search history.

(56) References Cited

U.S. PATENT DOCUMENTS

| | | | | |
|---|---|---|---|---|
| 1,991,237 | A | | 2/1935 | Waite |
| 2,815,112 | A | | 12/1957 | Engleson et al. |
| 3,201,912 | A | | 8/1965 | Wozniak |
| 3,967,336 | A | | 7/1976 | Cutter |
| 4,887,414 | A | | 12/1989 | Arena |
| 5,167,301 | A | | 12/1992 | Cappi et al. |
| 5,456,058 | A | | 10/1995 | Ziegler |
| 5,546,734 | A | | 8/1996 | Moncrief et al. |
| 5,567,104 | A | | 10/1996 | Focke et al. |
| 5,579,895 | A | | 12/1996 | Davis et al. |
| 5,638,663 | A | | 6/1997 | Robinson et al. |
| 5,666,789 | A | | 9/1997 | Ziegler |
| 5,692,361 | A | | 12/1997 | Ziegler et al. |
| 5,727,365 | A | * | 3/1998 | Lashyro et al. ..... 53/448 |
| 5,758,474 | A | | 6/1998 | Ziegler |
| 5,771,658 | A | | 6/1998 | Olson et al. |
| 5,775,067 | A | | 7/1998 | Hawley |
| 5,787,680 | A | | 8/1998 | Tisma et al. |
| 5,937,620 | A | | 8/1999 | Chalendar |
| 6,058,679 | A | | 5/2000 | Ziegler et al. |
| 6,711,878 | B1 | | 3/2004 | Paselsky et al. |
| 7,073,656 | B2 | | 7/2006 | Gust et al. |
| 7,470,102 | B2 | | 12/2008 | Gendron et al. |

FOREIGN PATENT DOCUMENTS

| | | |
|---|---|---|
| GB | 1 457 624 | 12/1976 |

* cited by examiner

*Primary Examiner*—Hemant M Desai
(74) *Attorney, Agent, or Firm*—Womble Carlyle Sandridge & Rice, PLLC

(57) ABSTRACT

A machine for packaging stacks of articles into containers using selectors for grouping the article stacks. The selectors include arrays of vertically spaced wedge members which engage the articles in each stack. The wedge members are aligned with slots in comb-like guide rails and operate to form groups of predetermined numbers of stacks of articles while keeping the articles in each stack in vertical alignment as they progress through the machine into the containers. A method of grouping stacked articles and a method of packaging stacked articles is also disclosed.

16 Claims, 6 Drawing Sheets

PACKAGING METHOD FOR STACKED ARTICLES

REFERENCE TO RELATED APPLICATION

This application is a divisional of U.S. patent application Ser. No. 11/773,031 filed 3 Jul. 2007 now U.S. Pat. No. 7,637,083, issued on Dec. 29, 2009, which in turn is a divisional of patent application Ser. No. 11/178,962, filed Jul. 11, 2005, now U.S. Pat. No. 7,240,467, issued on Jul. 10, 2007.

FIELD OF THE INVENTION

This invention relates to packaging machines, and in particular to continuous motion packaging machines in which stacks of articles are directed into cartons or other types of containers.

The entire content of each of the related applications identified above is hereby incorporated by reference as if fully set forth herein.

BACKGROUND OF THE INVENTION

Packaging machines are known in which the articles to be packaged, for example, cans or bottles, are directed along lanes between spaced guide rails toward cartons or other types of containers. The lanes are oriented at an angle to the path of travel of a plurality of spaced selectors, and at the location where the lanes and the path of travel of the selectors intersect, the selectors are forced between successive articles, causing a predetermined number of articles to be grouped in a desired configuration between successive selectors. As the selectors progress along their path of travel, the groups of articles are inserted into containers, which are transported in timed relation with the pockets between the selectors. Machines which operate in this manner are disclosed, for example, in U.S. Pat. No. 4,887,414 to Arena, and U.S. Pat. No. 5,546,734 to Moncrief et al., the entire disclosures of which are incorporated hereinto by reference.

While continuous motion packaging machines of the type described are effective in permitting high speed article packaging of articles into containers in a single layer, they may not be as effective when the articles are to be packaged in more than one layer in a stacked configuration. When stacks of articles pass along the lanes between the guide rails, the selectors, which are located underneath the guide rails, generally will only engage the bottom article of each of the moving stacks of articles. The upper articles in the stack, being under pressure from the following stacks, will tend to keep moving and, not being constrained by engagement with the selector, may move out of alignment with the bottom article of the stack and/or each other. This disrupts the feeding of the stacks into a container, and may require slowing down the operation of the machine, or, in an extreme case, stopping the machine if a jam occurs.

SUMMARY OF THE INVENTION

Accordingly, one aspect of the present invention is to provide a method and apparatus which will tend to prevent stacked articles from becoming misaligned when they are being loaded into containers in a packaging machine.

The present invention involves providing the packaging machine with a plurality of selectors, each of which comprises, at least at the end which engages the stack of articles, one or more vertically arrayed wedge members, the members having substantially the same width and geometry and being so spaced that at least one of them will engage each of the articles in the stack. Spacers are positioned between each pair of wedge members. The members and spacers are preferably releasably attached together, so that, by using members of various widths and geometries, and by interposing spacers of various thicknesses between the wedge members, the assembly of members and spacers can be adjusted to accommodate stacks of various numbers and/or sizes and shapes of articles which are to be packaged. In the area where the wedge members engage the articles, the ends of the guide rails are provided with horizontal slots in a comb-like configuration to allow the wedge members to pass through the guide rails, while the guide rail fingers defined between the slots engage the stacked articles.

Various other aspects, features, and advantages of the present invention will become more apparent upon reading the following specification in conjunction with the accompanying drawing figures.

DETAILED DESCRIPTION OF THE PREFERRED EMBODIMENTS

Figure 1:
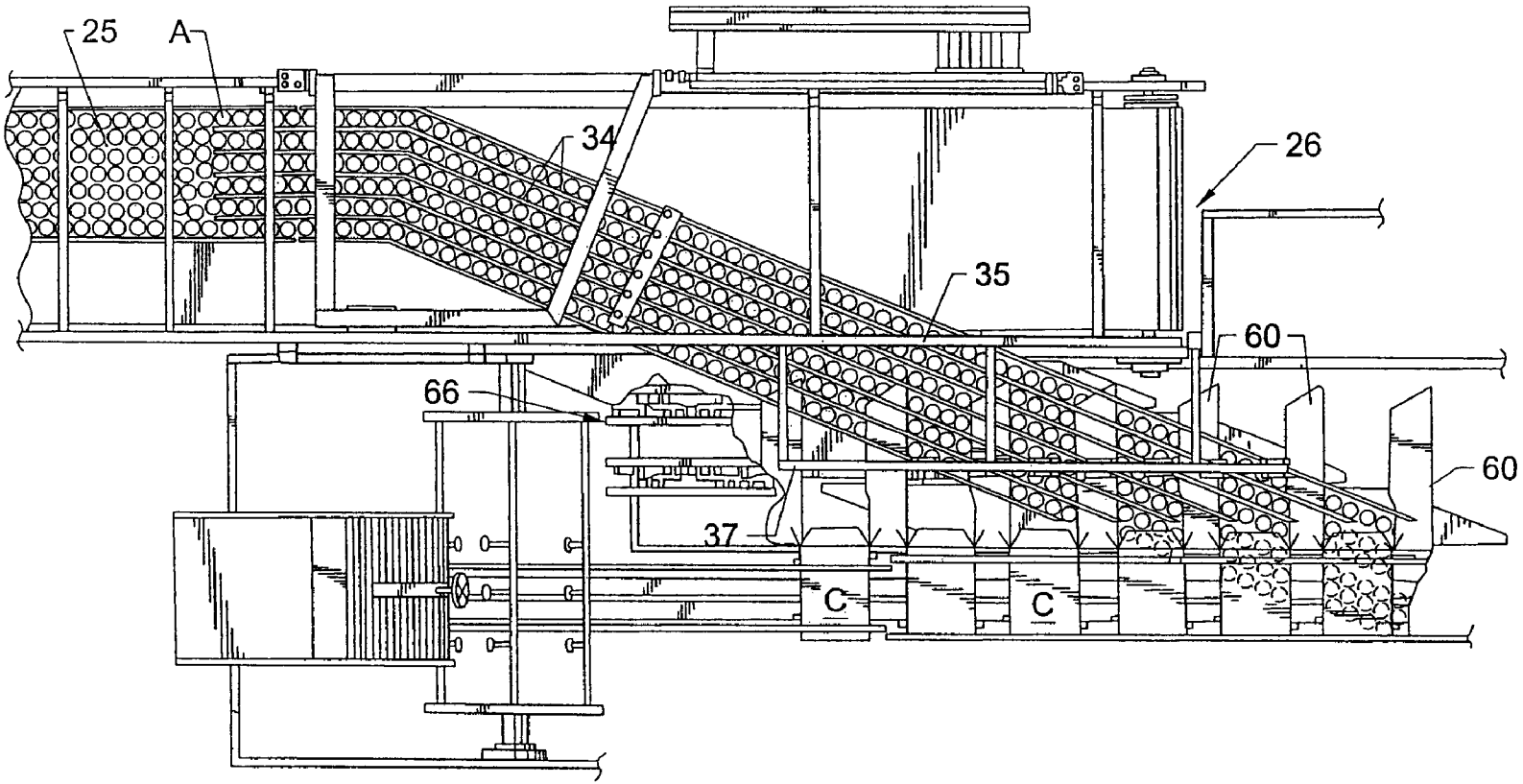
Fig. 1 Prior Art
FIG. 1 is a plan view of a known type of packaging machine
Figure 2:
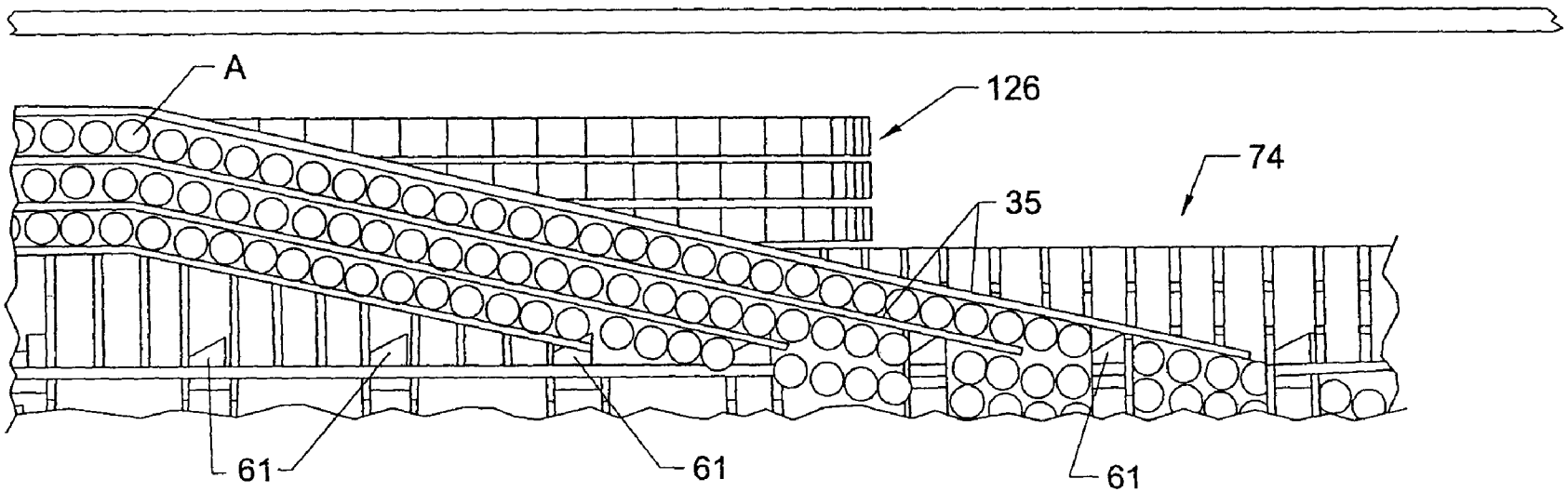
Fig. 2 Prior Art
FIG. 2 is a partial plan view of another known type of packaging machine

As an illustration of one particular embodiment of the type of packaging machine to which the present invention is applicable, FIG. 1 shows a plan view of the machine disclosed in the above-noted Moncrief et al. U.S. Pat. No. 5,546,734. In this type of machine, the articles to be packaged into containers, such as cartons C, are supplied through an infeed supply chute 25 and are directed by conveyor 26 between parallel, spaced guide rails 34, which are supported by beams 36, 37. The cartons are transported along a path which is parallel to conveyor 26 and at an angle to guide rails 34. Positioned between conveyor 26 and the carton transport, and parallel thereto, is a conveyor 66. The articles in the lanes between guide rails 34 move at an angle across the path of this conveyor 66, and slide across a stationary horizontal bed plate located above it. In the machine shown in FIG. 2, the articles are directed by conveyor 126 through the lanes between guide rails 35 and across the surface of a conveyor 74. In both machines, a plurality of horizontally disposed selectors 60 or 61 are attached to conveyor 66 or 74 at spaced positions therealong and are driven thereby in the same direction, and in a path parallel to, conveyor 26 or 126 and cartons C. Where the path of the selectors 60 or 61 intersects the lanes between the guide rails 34 or 35, the wedge-shaped ends of the selectors 60 or 61 are forced between successive articles in the lanes, grouping a predetermined number of articles between successive selectors 60 or 61. The space between successive selectors 60 or 61 may be adjusted, so that there will be the desired number of columns of articles in each pocket between the selectors 60 or 61; for example, as shown in FIGS. 1 and 2, the selectors 60 or 61 are spaced to select four rows of articles. Cartons C are transported in timed relationship with the spaces between selectors 60 or 61. As the selectors 60 or 61 and cartons C proceed to the right in FIGS. 1 and 2, and the articles proceed between the guide rails 34 or 35 in a direction which is at an angle to the direction of movement of the selectors 60 or 61 and the cartons C, the predetermined number of articles in the spaces between the selectors is directed into the open ends of the cartons by the force of the selectors 60 or 61 against the articles and the camming action of the guide rails 34 or 35.

The present invention is concerned with the use of a machines of this type, or the like, for packaging stacks of articles, i.e., where each item designated A in FIG. 1 or 2 would constitute a stack of two or more articles, rather than a single article.

Figure 3:
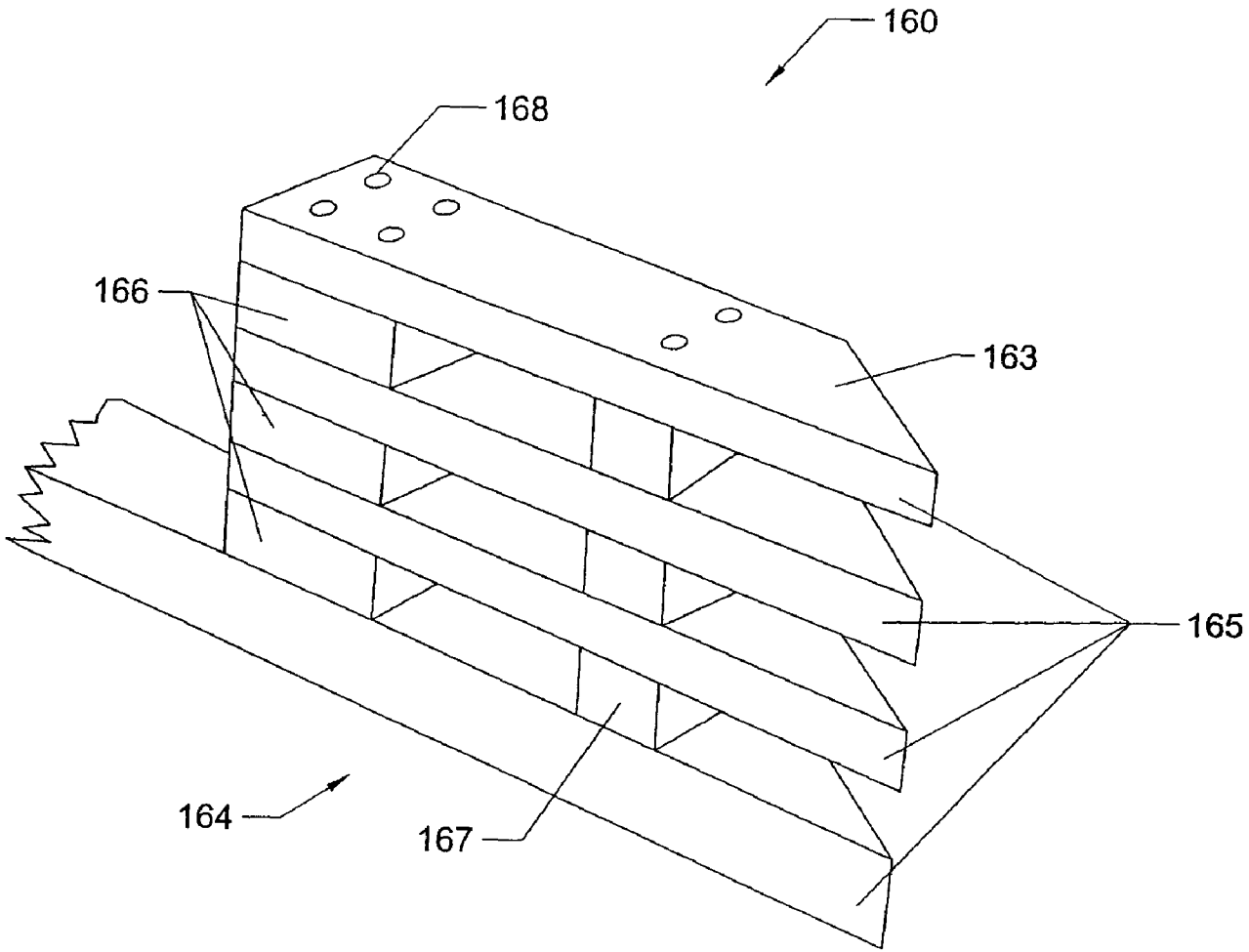
FIG. 3 is a perspective view of a selector having an array of wedge members.

In order to more effectively handle the packaging of such stacks of articles, the machine is modified by replacing the plurality of selectors 60 or 61 with a plurality of selectors 160, which are attached to the selector conveyor 66 or 74 of the machine in the same manner as the selectors 60 or 61 which they replace. In order to engage each of the articles in the stacks of articles being packaged, each selector 160 (FIG. 3) comprises, at least at its selection end 164, a vertically-aligned array of two or more article-engaging wedge members 165, all of which have wedge-shaped selector ends 163 of substantially the same width and geometry. The width and selector end geometry of the members 165 are determined based on the number of columns of articles to be selected for packaging into each container, the diameter of the articles being packaged, and other factors. The width and selector end geometry of the wedge-shaped members 165 may be determined in the same manner as described in the above-noted Moncrief et al. patent for determining the width and wedge-shaped end geometry of selectors 60.

Members 165 are held in vertically spaced relationship by spacers 166. Depending on the length of members 165, additional spacers 167 may also be used, if desired, to maintain the members 165 in parallel relationship. The arrangement of members 165, spacers 166, and spacers 167 (if used) is held together by bolts 168 or any other suitable fastening means, preferably one which will releasably attach the components of the array together, allowing disassembly of the array and substitution of other members and spacers as desired.

Alternatively, if a machine which already is provided with selectors is being modified in accordance with the invention to handle stacks of articles, it may be possible to retain the existing selectors 60 or 61 and modify them appropriately to allow the attachment of the members 165 and spacers 166, 167 to them, in which case the members 165 would have substantially the same width and selector end geometry as the existing selectors 60 or 61. The method of attachment would depend on the structure of the array; for example, if the members and spacers were held together by bolts 168, the existing selectors 60 or 61 might be drilled and tapped to allow the bolts 168 to be screwed into them.

Figure 4:
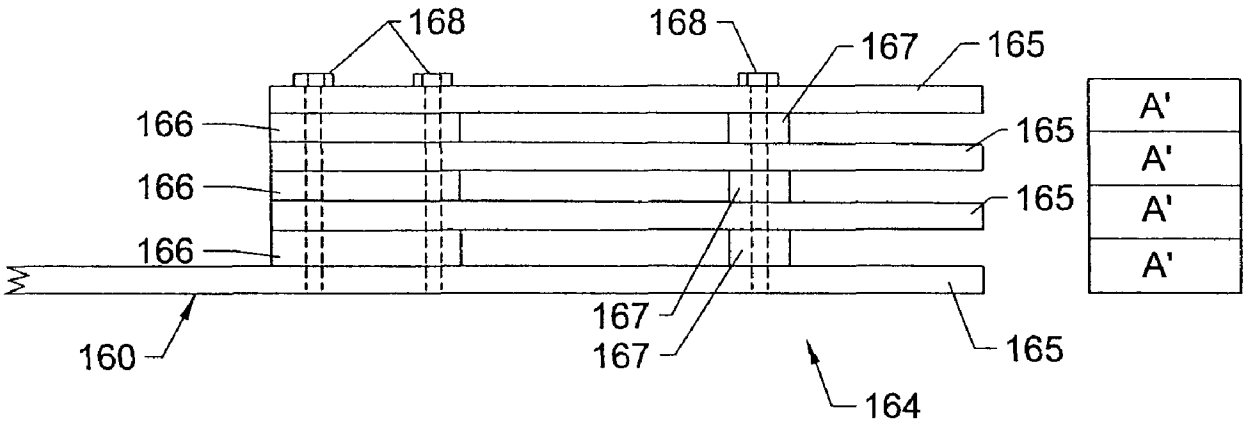
FIGS. 4 and 5 are side views illustrating two different arrays of wedge members and spacers for use in packaging two different stacks of articles.

The array of wedge members 165 at the end of selector 160 comprises a plurality of spaced article-engaging members. FIG. 4 shows the members 165 arranged to handle a stack of four articles A'. In general, it is preferred that the members 165 be vertically positioned so that each of them engages an individual article in the stack. Accordingly, the thickness of the spacers 166, 167 is selected so that each of the four members 165 in the array shown in FIG. 4 will engage a separate one of the articles A'.

It will be appreciated that the array shown in FIG. 4 could also be used where shorter stacks of articles A' are to be packaged. For instance, if a stack of two articles A' were to be packaged, either the top two members 165 and sets of spacers 166, 167 could be removed, or the assembly of FIG. 4 could be used without modification, in which case only the bottom two members 165 would engage the articles.

Figure 5:
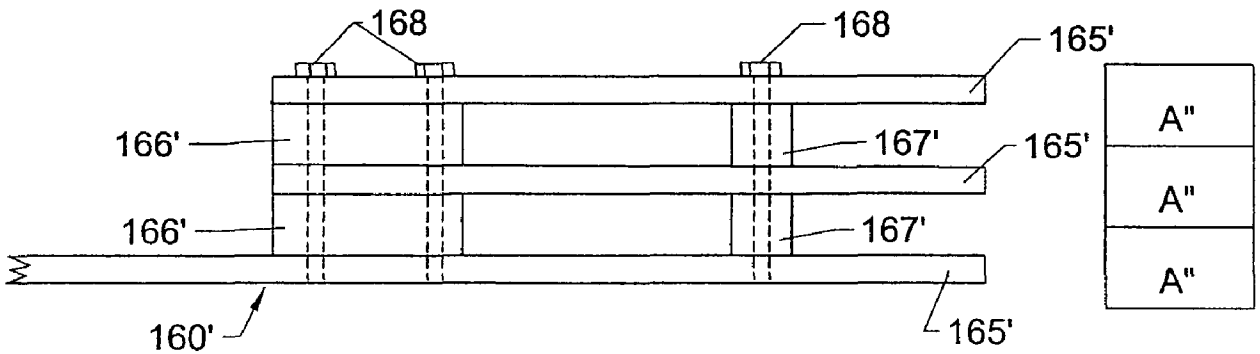

FIG. 5 shows how the arrangement of FIG. 4 could be modified to handle a stack of different articles. In this example, articles A" are thicker than articles A' and are to be packaged in stacks of three. To accommodate this stack, the arrangement shown in FIG. 4 would be disassembled by removing bolts 168. A new arrangement would then assembled using different wedge shaped members 165'. The wedge shaped, article engaging ends of the wedge shaped members 165' (end 164') would have a width and geometry determined, in the manner described above, as being appropriate for handling the articles A". Also, the arrangement could use different spacers 166' and 167', the thickness of the spacers preferably being selected so that each of the three members 165' would contact a separate article A" in the stack. The arrangement of wedge members 165' and spacers 166', 167' is then fastened together with bolts 168 and attached to the selector conveyor of the packaging machine.

Although it is preferred that the selection end 164 of each wedge member 165 of an array contact a separate article in a stack to be packaged, the members may also be positioned in a vertical array where one or more of them will contact more than one article. Alternatively, depending on the circumstances, it may be satisfactory in some instances for one or more of the articles in the stack not to be contacted by any of the wedge members 165, as long as there is sufficient contact between the wedge members 165 and the remaining articles in the stack that the articles in the stack do not become misaligned relative to each other during the packaging process.

Figure 6:
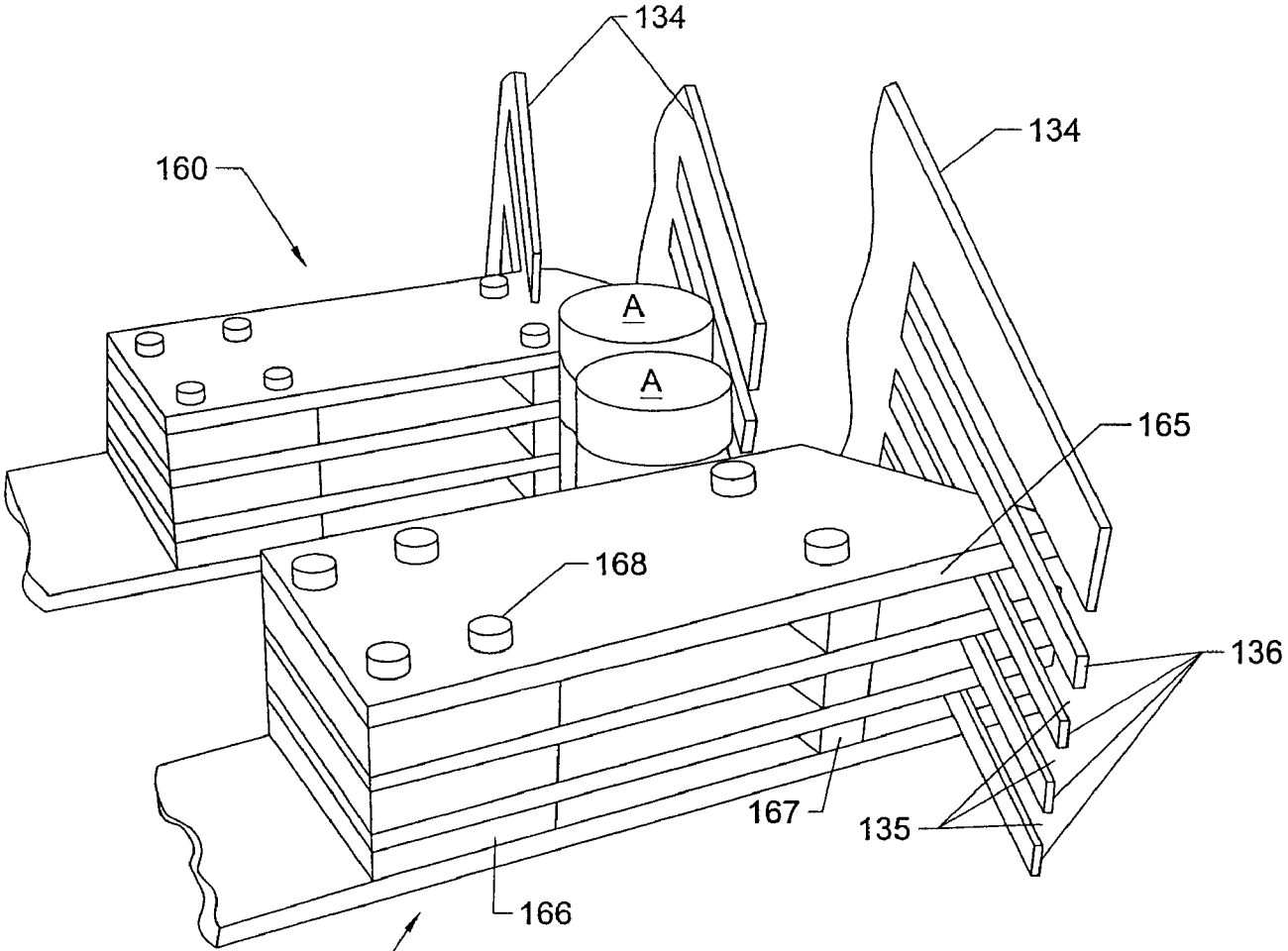
FIG. 6 is a perspective view showing the interleaving of the wedge members of the selectors with the comb-like guide rail ends.

When selectors 160 are used in packaging machines of the types shown in FIGS. 1 and 2, or the like, the ends of the guide rails 34 or 35, in the region where they are intersected by selectors 160, are replaced by modified guide rails 134, as shown in FIG. 6. Guide rails 134 are comb-like in appearance, being provided with vertically aligned arrays of parallel, horizontal slots 135, the slots being aligned with the members 165 of the selectors 160 so that members 165 can pass through them, with the selection end 164 of bottom member 165 passing underneath the bottom of the guide rails 134. Defined between slots 135 are horizontal fingers 136, which lie in substantially the same horizontal planes as spacers 166, 167.

The width of slots 135 and, correspondingly, the width of fingers 136, are generally determined by two criteria: (1) the slots 135 must be sufficiently wide to allow wedge members 165 to pass through them, and (2) fingers 136 will typically be sufficiently wide so that every article in a stack of articles will be contacted by at least one finger. This allows the fingers 136 to engage all of the articles in the stack, and prevents any of the articles from inadvertently passing through slots 135.

In operation, when the packaging machine is to be used to package stacks of articles into containers C, a plurality of selectors 160 is provided. Each selector 160 comprises a vertically spaced array of wedge shaped members 165, separated by spacers 166 (and 167 if desired), the wedge shaped members each having substantially the appropriate width and geometry for the particular articles to be packaged. The members 165 are so spaced vertically that typically at least one of them will engage each article in a stack. If there are existing selectors already in use on the machine, they may be used as the bottom members of the arrays if their width and geometry is appropriate for the articles to be handled, in which case the spacers and remaining member or members 165 of the array will be attached to each of the existing selectors to form the arrays in accordance with the present invention. In either case, the number of wedge members, and their spacing, is selected as described previously.

The selectors 160 are installed onto the selector conveyor of the machine in positions spaced along the conveyor, their positions on the conveyor being chosen depending upon the desired product configuration. As shown in FIG. 6, comb-like guide rails 134, with horizontal slots 135, are provided at the regions of the guide rails closest to the containers C, so that the slots 135 and members 165 are "interleaved" with each other, allowing members 165 to project through the slots as the selectors 160 progress along their path of travel (toward the right in FIGS. 1 and 2) while fingers 136 pass through the spaces defined by spacers 166, 167. As the stacks of articles A pass along the lanes defined by guide rails 134, the selectors 160 are forced between successive stacks of articles by the longitudinal movement of selection ends 164, and cooperate with the guide rails to group a predetermined number of stacks of articles between successive selectors 160. The wedge members 165 engage the individual articles in a stack, as described above, and at the same time the individual articles in a stack may be engaged by the fingers 136 of the guide rails 134. Thus, the articles in each stack are engaged at their sides by wedge members 165, fingers 136, and/or the articles in the adjacent stack or stacks with which they are in contact. This engagement maintains the articles in the stack in vertical alignment and prevents the articles from shifting out of position relative to each other as they progress along the lanes between the guide rails 134 and thence into cartons C.

Figure 7:
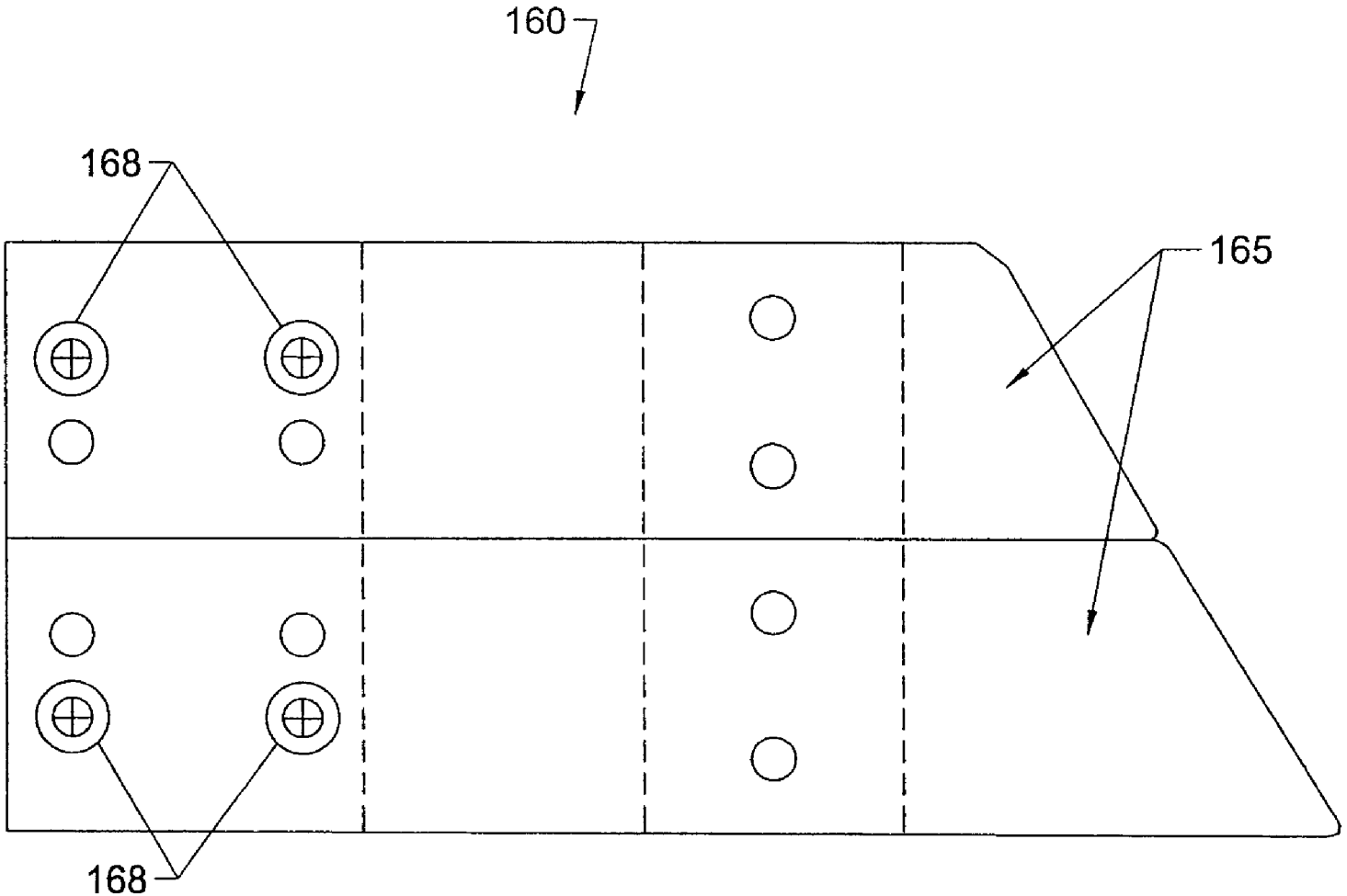
FIG. 7 is a top view of the wedge members on two selectors in a side by side nesting arrangement.

Depending upon the particular product group configuration being packaged, the selectors 160 may be attached to the selector conveyor so that two or more of them are directly side by side in a nesting arrangement at each position on the conveyor, giving a combined, suitable nested wedge shape, as shown in FIG. 7.

Wedge members 165 preferably are comprised of any suitable low friction material. For example, they may be injection molded of a low friction synthetic material such as nylon or polytetrafluoroethylene (Teflon®), or may be made of metal coated with such a low friction material.

While a preferred embodiment of the invention has been described above, it is recognized that variations may be made with respect to features and components of the invention. Therefore, while the invention has been disclosed in preferred form only, it will be obvious to those skilled in the art that many additions, deletions, and modifications can be made therein without departing from the spirit and scope of this invention, and that no undue limits should be imposed thereon except as may be set forth in the following claims.

What is claimed is:

1. A method of arranging stacked articles into groups for packaging into cartons in a packaging machine having a downstream direction and guide rails extending at an angle to the downstream direction for guiding lanes of stacked articles toward the ends of spaced selectors moving in the downstream direction, the method comprising:

(a) configuring at least the ends of the selectors to have at least one substantially horizontal space;

(b) configuring at least the ends of the guide rails to have at least one substantially horizontal finger aligned with the space; and (c) moving the at least one finger through the at least one space as the ends of the selectors move past the ends of the guide rails.

2. The method of claim 1 and wherein step (a) comprises separating selector members by spacers to define the space between the separated selector members.

3. The method of claim 2 and wherein the separation of the selector members is preselected so that at least one selector member is aligned with each article of the stacked articles.

4. The method of claim 2 and wherein the selector members have wedge-shaped ends to define selector ends that are correspondingly wedge shaped.

5. The method of claim 1 and wherein the selector ends are generally wedge-shaped.

6. The method of claim 1 and wherein step (b) comprises configuring at least the end of the guide rails to have a comb-like shape with a gap disposed on either side of the at least one finger.

7. The method of claim 6 and wherein step (a) comprises configuring at least the ends of the selectors to have a plurality of horizontal spaces and step (b) comprises configuring at least the ends of the guide rails to have a plurality of fingers separated by a plurality of gaps, each finger aligning with a corresponding horizontal space.

8. A method of transferring articles to be packaged from infeed lanes between guide rails to spaces between selectors on a selector bed moving at an angle to the guide rails with ends of the selectors intersecting downstream ends of the guide rails, the method comprising shaping the selectors and the downstream ends of the guide rails so that the ends of the selectors and the downstream ends of the guide rails interleave to allow the ends of the selectors to pass through the downstream ends of the guide rails upon intersection.

9. The method of claim 8 and further comprising shaping at least the ends of the selectors to have a plurality of wedge members separated by spaces and shaping at least the downstream ends of the guide rails to have a plurality of slots aligned with the wedge members, the wedge members passing through the slots upon intersection of the selectors with the downstream ends of the guide rails.

10. The method of claim 9 and wherein stacks of articles are transferred from the infeed lanes to the spaces between selectors and wherein the wedge members are positioned such that at least one wedge member is aligned horizontally with each article in the stacks of articles.

11. The method of claim 9 and wherein the step of shaping at least the ends of the selectors further comprises disposing spacers between the wedge members to define spaces between wedge members.

12. The method of claim 9 and wherein the step of shaping at least the downstream ends of the guide rails comprises forming the downstream ends with a comb-shaped profile to define the slots.

13. A method of packaging stacks of articles into cartons in a packaging machine, the method comprising the steps of:

(a) conveying the stacks of articles in a first direction along a plurality of lanes defined between upstanding guide rails;

(b) engaging each article of at least some of the stacks of articles within the lanes with spaced selector wedges moving in a second direction past end portions of the guide rails to arrange the stacked articles into groups of stacked articles between selector wedges; and (c) moving the groups of stacked articles into cartons.

14. The method of claim 13 and wherein the selector wedges are configured with vertically spaced wedge members and wherein step (b) comprises engaging each article of at least some of the stacks with at least one wedge member of the selector wedges.

15. The method of claim 14 and wherein the end portions of the guide rails are formed with slots aligned with the wedge members and teeth aligned with the space between the wedge members and wherein step (b) comprises engaging each article of at least some of the stacks of articles with spaced selector wedges when the stacks of articles are disposed in lanes between end portions of the guide rails.

16. The method of claim 15 and further comprising passing the wedge members through the slots as the selector wedges intersect the end portions of the guide rails to allow the selector wedges to move through the end portions of the guide rails.

* * * * *